US006050483A

United States Patent [19]

Haraldsson et al.

[11] Patent Number: 6,050,483

[45] **Date of Patent: *Apr. 18, 2000**

[54] SELF-LOCKING PAPERBOARD PAIL-LIKE CONTAINER AND PRODUCT THEREOF

[75] Inventors: Rune Karl Haraldsson; Kenneth James Reeves, both of Wilmington; Arthur Winfield Twitchell, Newark, all of Del.

[73] Assignee: Westvaco Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/030,783

[22] Filed: Feb. 26, 1998

Related U.S. Application Data

[62] Division of application No. 08/784,461, Jan. 16, 1997, Pat. No. 5,873,220.

[51] Int. Cl.[7] ..... B65D 5/24

[52] U.S. Cl. ..... 229/114; 229/155; 229/186; 229/911

[58] Field of Search ..... 229/114, 155, 229/186, 189, 910, 911

[56] References Cited

U.S. PATENT DOCUMENTS

| | | | |
|---|---|---|---|
| 396,570 | 1/1889 | Hotchkiss | 229/189 |
| 679,917 | 8/1901 | Schmidt | 229/189 |
| 717,775 | 1/1903 | Single | 229/911 |
| 906,485 | 12/1908 | Bloomer | 229/911 |
| 2,145,993 | 2/1939 | Pulsifer | 229/189 |
| 2,336,655 | 12/1943 | Toby et al. . | |
| 2,355,729 | 8/1944 | Inman . | |
| 2,355,730 | 8/1944 | Inman . | |
| 4,558,815 | 12/1985 | Wischusen, III | 229/186 |
| 5,217,159 | 6/1993 | Calvert et al. . | |
| 5,411,204 | 5/1995 | DeMay . | |
| 5,620,134 | 4/1997 | Gulliver . | |

*Primary Examiner*—Gary E. Elkins
*Attorney, Agent, or Firm*—J. R. McDaniel; R. L. Schmalz

[57] ABSTRACT

This invention relates to paperboard containers. Such structures of this type, generally, allow for the container to be formed into a self-locking, pail-like container for holding food stuffs.

3 Claims, 4 Drawing Sheets

SELF-LOCKING PAPERBOARD PAIL-LIKE CONTAINER AND PRODUCT THEREOF

This is a divisional of application Ser. No. 08/784,461 filed on Jan. 16, 1997 now U.S. Pat. No. 5,873,220.

BACKGROUND OF THE INVENTION

1. Field of the Invention

This invention relates to paperboard containers. Such structures of this type, generally, allow for the container to be formed into a self-locking, pail-like container for holding food stuffs.

2. Description of the Related Art

It is known, in the food industry, to employ a paperboard pail which is capable or being self-locking. Exemplary of such prior is art is commonly found in the Chinese-food take-out industry. For example, Chinese-food take-out orders are boxed in paperboard pails having a wire handle. Commercial products of this type have been sold by the Fold-Pak Corporation since approximately 1977. While these prior, paperboard pails are capable of containing food, these pails cannot be microwaved if the food needs to be reheated due to the presence of the wire handle. Therefore, a more advantageous container, then, would be presented if the container could be microwaved.

Also, if a food package were to employ the pail container having the wire in a mass production facility, the wire would dramatically slow down the filling lines. Typically, a mass production food filling line is run so that 60 containers per minute are folded, filled and sealed. Clearly, the added production step of attaching the wire handle would adversely affect the speed of the filling lines. Therefore, a further advantageous container, then, would be one which could be easily converted into a container.

In order to avoid the use of the metallic wire, trays were developed that sealed each of the gussets to the side walls. Exemplary of such prior art is U.S. Pat. No. 5,411,204 ('204) to K. F. DeMay entitled "Reclosable Food Tray and Tray Blank". While the tray of the '204 patent eliminates the use of the metal wire and thus can be put in a microwave oven, the tray also employs the use of adhesives in order to seal the gussets to the side walls. While the adhesives allow for the gussets to be sealed to the side walls, the adhesive may contaminate the food product contained within the tray particularly during heating of the tray and the food product. For example, if a pinhole develops in the tray and the adhesive migrates to the pinhole and into the food stuff, the food may become contaminated or develop an off-taste and/or odor. Also, the use of the adhesive adds to the coat of manufacturing the tray and adds another step in the production of the tray. Finally, upon heating, the adhesive may break down, melt and allow the gussets to become dislodged from the sidewall panels. Therefore, a still further advantageous container, then, would be presented if the use of the adhesives could be eliminated.

It is apparent from the above that there exists a need in the art for a paperboard, pail-like container which is self-locking and easily converted, and is capable of being put in the microwave oven, but which at the same time avoids the use of adhesives. It is the purpose of this invention to fulfill this and other needs in the art in a manner more apparent to the skilled artisan once given the following disclosure.

SUMMARY OF THE INVENTION

Generally speaking, this invention fulfills these needs by providing a method for producing a self-locking, paperboard pail-like container, comprising the steps of: creating a paperboard blank such that the blank includes a plurality of corners comprising a polygonal-shaped bottom panel having a plurality of side edges, wherein the bottom panel further includes a first dimension measured between non-adjacent corners of the bottom panel, a sidewall panel including a plurality of corners foldably attached to each side edge of the bottom panel wherein each sidewall panel further includes a second dimension measured between non-adjacent corners of each of the sidewall panels such that the second dimension of the sidewall panels is substantially longer than the first dimension of the bottom panel in order to create a pail-like container, a closure panel foldably attached to each of the sidewall panels, gusset panels foldably attached to one another and to adjacent ends of the sidewall panels wherein the gusset panels further include a masked area located substantially adjacent to an edge of at least two of the gusset panels and a cut-away area located substantially adjacent to an edge of at least two other gusset panels, and a locking means located on at least two of the closure panels; coating a first side of the blank with a layer of particulate minerals; coating a second side of the blank with a heat-sealable, polymeric material coating the first side of the blank with a layer of printed graphics such that the printed graphics are masked from adhering to the first side by the masked area located on the gusset panels; folding the blank such that the sidewall panels are folded towards the bottom panel and adjacent gusset panels contact each other with the coating of heat-sealable, polymeric material located between the gusset panels in contact; sealing the gusset panels together to form gussets; folding the sealed gussets such that adjacent gussets substantially overlap one another and a portion of one of the adjacent gussets substantially adjacent to the cut-away area contacts and overlaps the masked area; sealing the overlapping gussets to each other to form a pail-like container; placing food stuff within the pail-like container; and locking the locking means on the closure panel.

In certain preferred embodiments, the gussets are sealed to each other in order to eliminate the migration of fluids up through the gussets during the cooking of the food. Also, the gussets are sealed to each other in order to provide structural integrity to the pail-like container.

In another further preferred embodiment, the sealing of the gussets to one another eliminates the use of adhesives in that the gussets do not have to be sealed to the sidewall panels.

The preferred pail-like container, according to this invention, offers the following advantages: ease of assembly; reduced migration of fluids during cooking; improved structural integrity; the elimination of adhesives; dual ovenable usage; and good economy. In fact, in many of the preferred embodiments, these factors of ease of assembly, reduced migration of fluids, improved structural integrity, adhesive elimination, and dual ovenable usage are optimized to the extent that is considerably higher than heretofore achieved in prior, known containers.

The above and other features of the present invention, which will become more apparent as the description proceeds, are best understood by considering the following detailed description in conjunction with the accompanying drawings, in which:

DETAILED DESCRIPTION OF THE INVENTION

Figure 1:
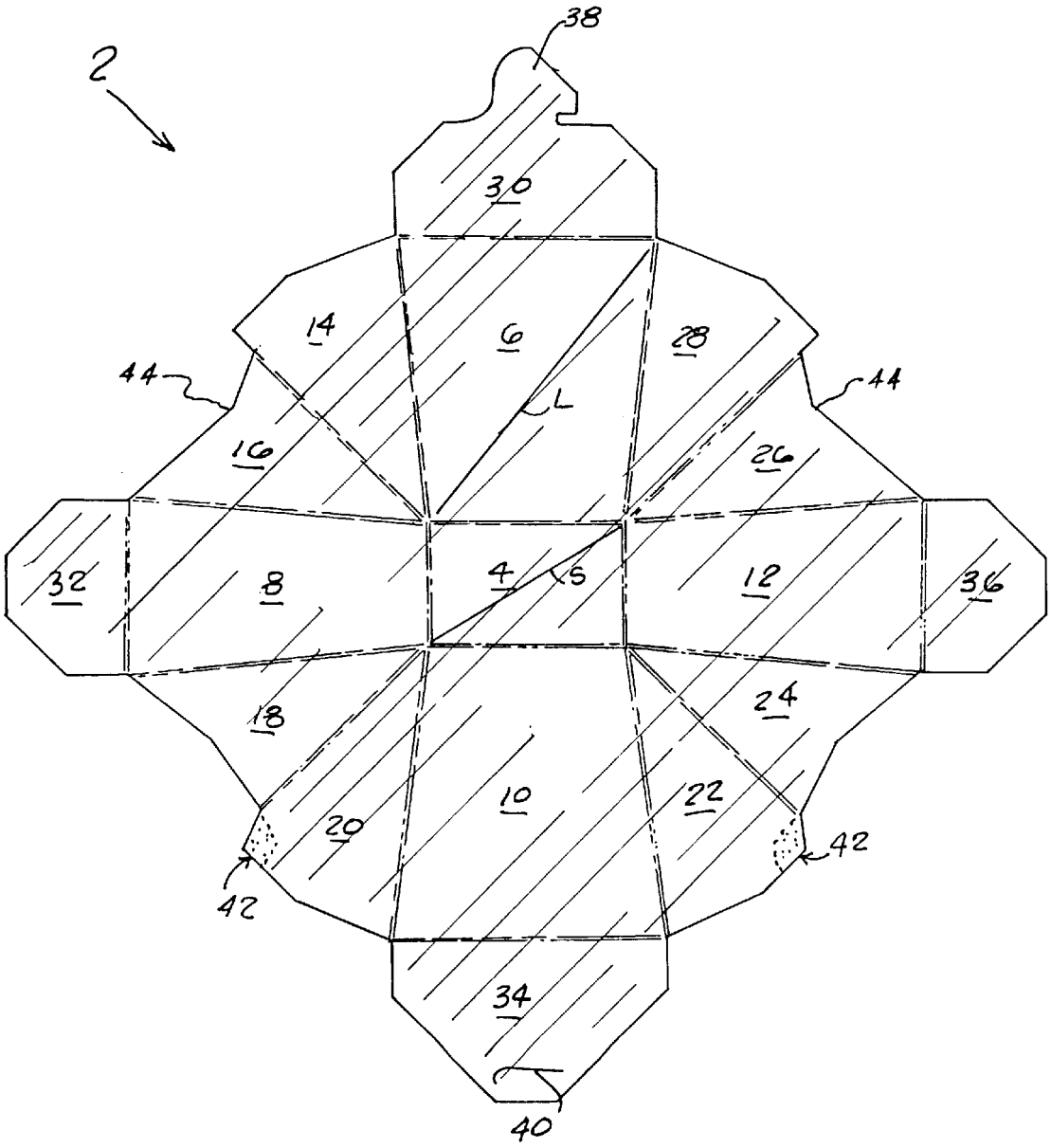
FIG. 1 is a top plan view of a blank structure for forming the pail-like container of the present invention.

With respect to FIG. 1, there is illustrated blank 2 which is used to construct the pail-like container 50 (FIG. 4), which will be discussed later. In particular, blank 2 includes, in part, bottom panel 4, sidewalls panels 6, 8, 10, and 12, gussets panels 14, 16, 18, 20, 22, 24, 26, and 28, closure panels 30, 32, 34, 36, locking tab 38, slot 40, masked areas 42 and cut-away areas 44.

Blank 2, preferably, includes a paperboard substrate, typically, a 0.016" thick sheet. Definitely, the term "paperboard" describes paper within the thickness range of 0.008 to 0.028 inches. The invention is relevant to the full scope of such a range, as applied to packaging and beyond.

Blank 2, typically, receives, on the under face or side (the side not shown in FIG. 1), a fluidized mixture of finely particulated minerals and binders as a smooth coating. Minerals such as clay and calcium are most frequently used. Successive densification and polishing by calendering, finishes the mineral coated surface to a high degree of smoothness and a superior graphics print surface which is subsequently applied to the under face or side of blank 2. This printed surface is prepared to become the exterior surface of the present invention food package.

Figure 2:
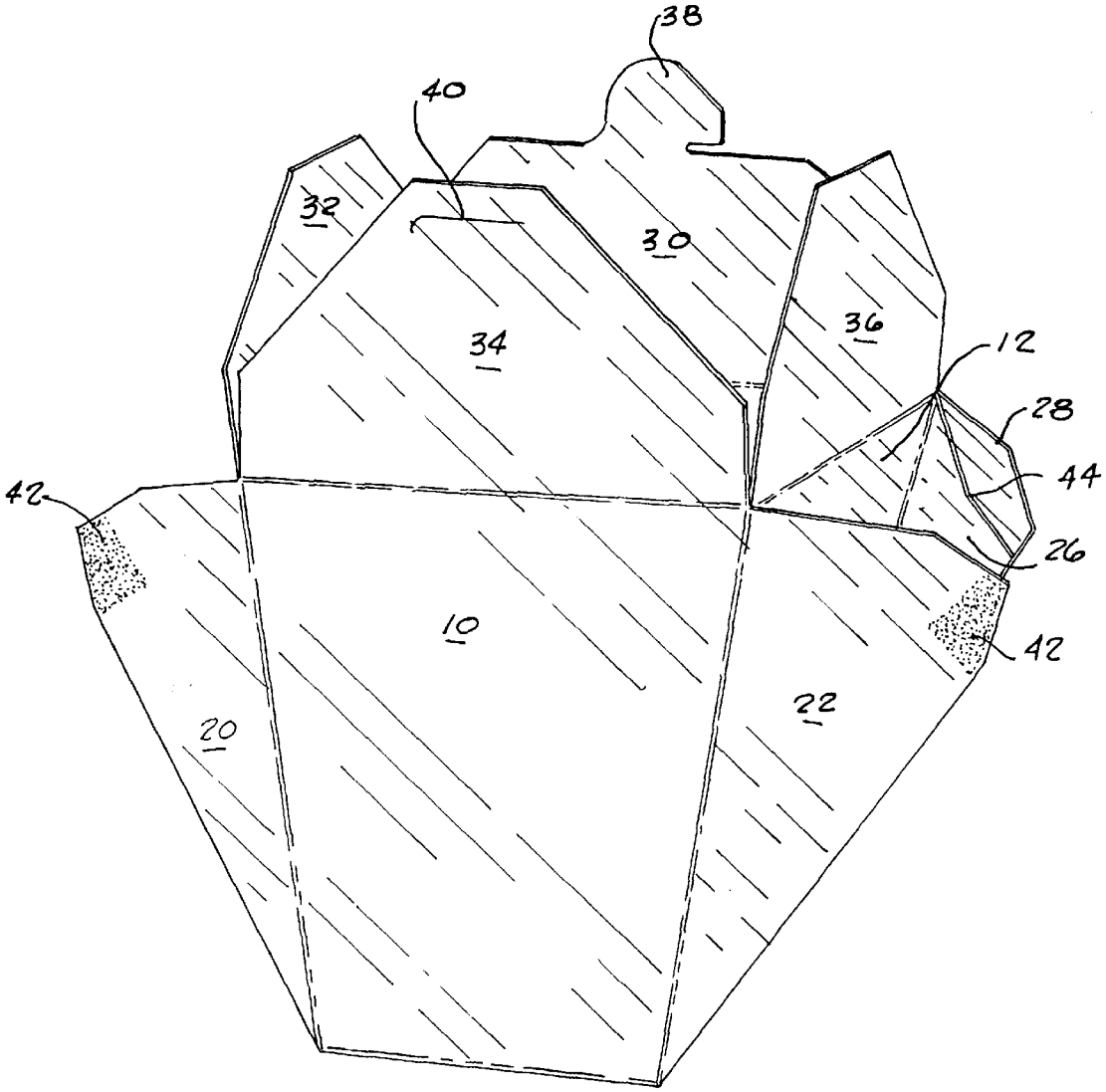
FIG. 2 is an isometric view of the pail-like container, according to the present invention, with the gusset panels being folded with the intention of the gussets being sealed to each other.

However, as more clearly seen in FIG. 2, there is a portion 42 located on gusset panels 20 and 22 which is masked by conventional techniques to prevent the printed graphics from being placed over the clay coating. Also, cut-away area 44 is formed in blank 2 by conventional techniques. The masking and cut-away areas allow for the gussets to be easily sealed once they are overlapped, as more clearly shown in FIG. 3. This overlapping and sealing will be discussed in more detail later.

The other side or face of the blank 2, namely, the side shown in FIG. 1, is coated with an extruded film of polymer for the purpose of a protective barrier, moisture confinement, and heat sealability. In a conventional extrusion process, the polymer is heated to a viscous flow temperature and extruded as a curtain onto the travelling surface of the web or sheet. Ten to eleven lbs. of polymer per ream (3,000 ft.$^2$) of paperboard surface is an adequate application rate for most purposes. However, rates of 5–20 lbs. per ream have been used. Exemplary of such polymeric materials used for the polymeric coating are polyethylene, polyethylene terephthalate, polypropylene, and polyester.

As a further discussion of the pail-like concept of the present invention, one is invited to again review FIG. 1. In particular, as shown along bottom panel 4, a short diagonal line (S) is drawn between non-adjacent corners of bottom panel 4. Line 5 is proportional to the area of bottom panel 4. It must also be pointed out that bottom panel 4 can be any polygonal shape and not just the rectangular shape shown in the Figures.

Conversely, as shown in sidewall panel 6, there is a longer line (L) which is drawn between non-adjacent corners of sidewall panels 6. Again, line L is proportional to the area of sidewall panel 6. In order for blank 2 to form a pail-like container, line L must be substantially longer than line S. In this manner, the container formed from blank 2, should be taller than it is wider (at least at the bottom) in order to form the pail-like container.

During the construction of the pail-like container, as shown in FIG. 2, the polymer coated surfaces of gusset panels 26 and 28 are folded together, contacted, and sealed. Also, gusset panels 22, 24 and 18, 20 and 14, 16 are folded, contacted, and sealed together, respectively. Adjacent gusset panels are sealed together to form gussets in order to provide structural integrity to the pail-like container. Also, the sealing of the adjacent gusset panels to form gussets prevents migration of fluids up through the gussets during the cooking of the food stuffs located within the pail-like container. If the fluids migrate up and out of the gussets, the fluids may create an unslightly mess on the container and/or the cooking oven. Finally, masked area 42 can be seen in FIG. 2 on the outside of gussets form by panels 20, 18, and 22, 24. Also, cut-away area 44 near gusset panel 26 is illustrated. It is to be understood that at least two masked areas 42 and cut-away areas 44 must be included.

Figure 3:
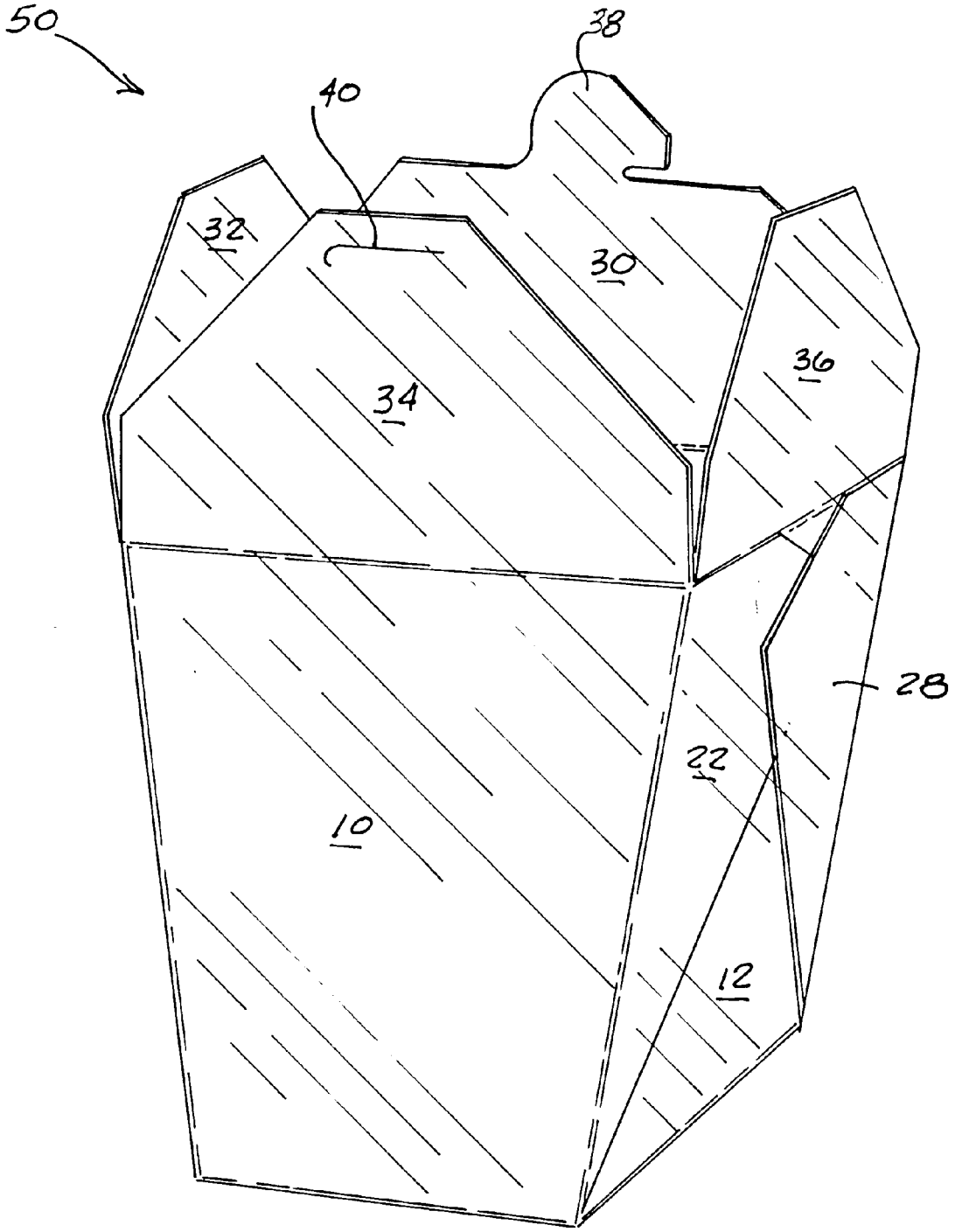
FIG. 3 is an isometric view of the pail-like container, according to the present invention, with the gussets being overlapped and sealed to each other.

After the adjacent gusset panels are folded, contacted and sealed together, the gussets thereafter formed are further folded and overlapped as shown in FIG. 3. FIG. 3 shows gussets formed from panels 22, 24 and 28, 26 being overlapped such that a portion of the gusset formed by panel 22 contacts the gusset formed by panel 28 at masked area 42 and cut-away area 44. In this manner, masked area 42 on gusset panel 22 contacts the polymeric coating on gusset panel 28 near cut-away area 44 on gusset panel 26 such that the particulate coating of masked area 42 is adhered to the polymeric coating on panel 28 near cut-away area 44 on panel 26.

After the gusset formed by panel 28 is overlapped the gusset formed by panel 22, the gusset formed by panels 22 and 28 are sealed together by conventional heat sealing techniques. It is to be understood that the gussets formed by panels 14 and 18 are overlapped and sealed in the same manner (not shown). In this manner, the gussets formed by panels 14 and 18 end 22 and 28 are sealed together in order to create pail-like container 50 and to provide structural integrity to pail-like container 50 without adhering any of the gussets to their adjacent sidewall panels.

Figure 4:
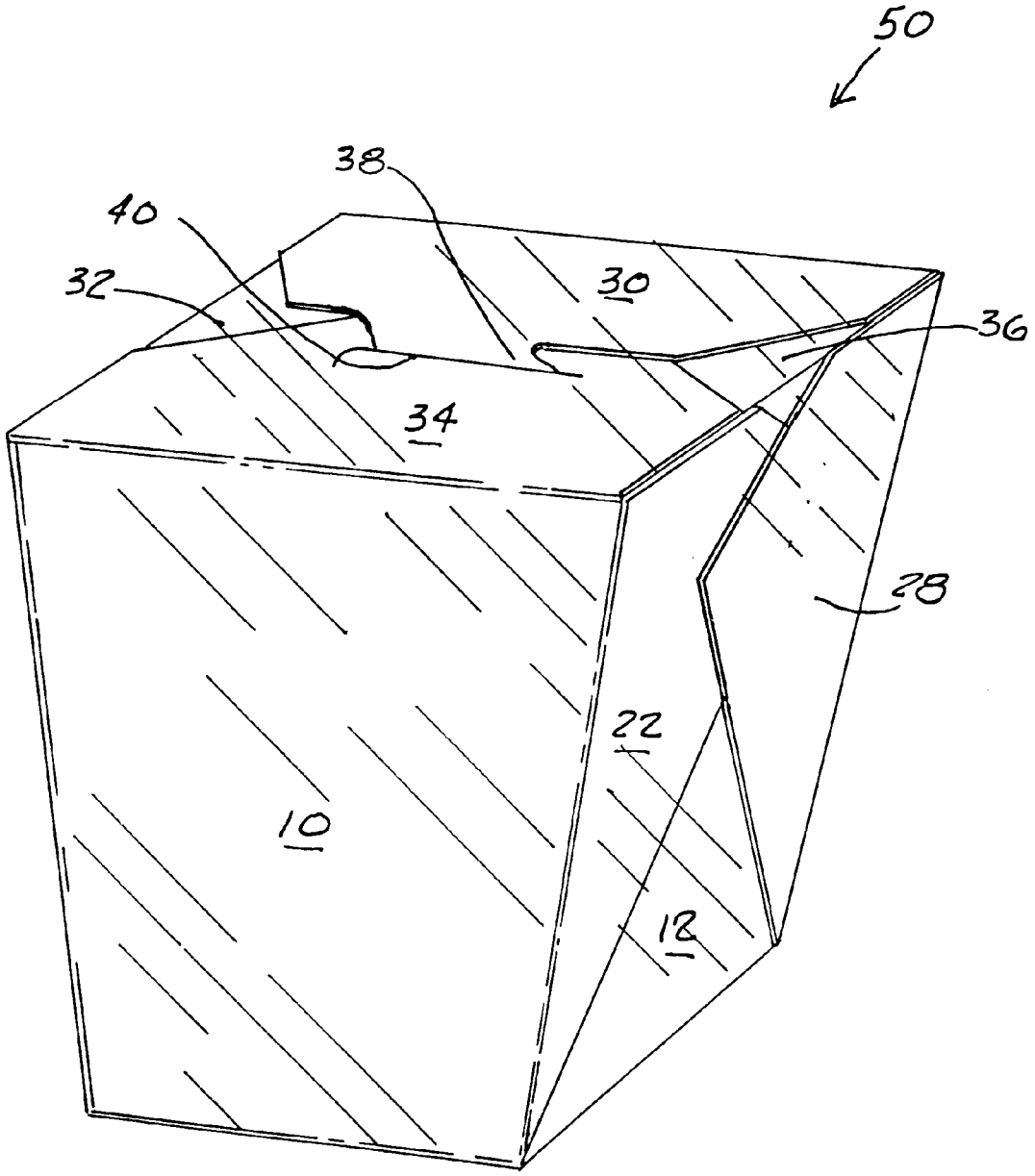
FIG. 4 is an isometric view of the closure panels being folded and locked, according to the present invention.

After the gussets are sealed to one another, food stuffs are placed within pail-like container 50 by conventional food filling techniques. After the food stuffs are placed in pail-like container 50, closure panels 32 and 36 are first folded and overlapped. Finally, closure panels 30 and 34 are overlapped such that tab 38 is inserted within slot 40 to lock closure panels 34 and 30 over closure panels 32 and 36, as shown in FIG. 4. It is to be understood that tab 38 and slot 40 may be omitted and closure panels 34 and 38 can overlap closure panels 32 and 36 and sealed to the top of closure panels 32 and 36 by conventional techniques.

The construction of self-locking pail-like.container 50 allows container 50 to be placed in a microwave or conventional oven (dual ovenability) to heat the food stuffs. Also, container 50 does not employ adhesives, is structurally sound and decreases the likelihood of fluids from the food stuffs migrating up the gussets.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A self-locking, paperboard pail-like container, wherein said container is comprised of:

an exterior side which is comprised of a layer of particulate minerals and a layer of printed graphics located substantially over said layer of particulate minerals except at a masked area;

an interior side which is comprised of a layer of heat-sealable polymeric material;

a polygonal-shaped bottom panel having a plurality of side edges wherein said bottom panel further includes a first dimension measured between non-adjacent corners of said bottom panel;

a sidewall panel including a plurality of corners foldably attached to each side edge of said bottom panel wherein each said sidewall panel further includes a second dimension measured between non-adjacent corners of each of said sidewall panels such that said second dimension of said sidewall panels is substantially longer than said first dimension of said bottom panel in order to create a pail-like container;

a closure panel foldably attached to each of said sidewall panels wherein two of said closure panels further include a locking means such that said closure panels are folded over to create a self-locking pail-like container, wherein said locking means are further comprised of a tab located on-one of said closure panels and a slot located on another of said closure panels;

gusset panels foldably attached outwardly from said sidewall panel and to one another and to adjacent ends of said sidewall panels to provide structural integrity to said pail-like container wherein said gusset panels further include said masked area located substantially adjacent to an edge of at least two of said gusset panels and a cut-away area located substantially adjacent to an edge of at least two other gusset panels wherein said adjacent gusset panels are attached to each other by said heat sealable polymeric material to form gussets and said adjacent gussets are folded and overlap each other substantially at said masked area and said cut-away area to create said pail-like container such that said masked area is adhered to a portion of said container located substantially within said cut-away area and said folded gusset panels are not adhered to said sidewall panel.

2. The pail-like container, as in claim 1, wherein said bottom panel is square-shaped.

3. The pail-like container, as in claim 1, wherein said bottom panel is rectangular.

* * * * *

UNITED STATES PATENT AND TRADEMARK OFFICE

CERTIFICATE OF CORRECTION

PATENT NO. : 6,050,483

DATED : Apr. 18, 2000

INVENTOR(S) : Rune Karl Haraldsson; Kenneth James Reeves and Arthur Winfield Twitchell It is certified that error appears in the above-indentified patent and that said Letters Patent is hereby corrected as shown below:

Column 1, line 52, "coat" should be --cost--. Column 2, line 23, following "material" should be --;--. Column 3, line 57, "5" should be --S--. Column 4, line 52, following "like" delete --.--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*